United States Patent [19]

Svengren

[11] Patent Number: 4,509,700

[45] Date of Patent: Apr. 9, 1985

[54] METHOD OF AND A MACHINE FOR DISINTEGRATING MATERIALS

[75] Inventor: Anders G. Svengren, Klippan, Sweden

[73] Assignee: Nestec S.A., Vevey, Switzerland

[21] Appl. No.: 193,407

[22] PCT Filed: Apr. 26, 1979

[86] PCT No.: PCT/CH79/00058

§ 371 Date: Jan. 2, 1980

§ 102(e) Date: Jan. 2, 1980

[87] PCT Pub. No.: WO79/01038

PCT Pub. Date: Nov. 29, 1979

[30] Foreign Application Priority Data

May 8, 1978 [CH] Switzerland ..... 4990/78

[51] Int. Cl.[3] ..... B02C 19/22

[52] U.S. Cl. ..... 241/280; 241/260.1; 241/283

[58] Field of Search ..... 241/283, 280, 205, 281, 241/277, 260.1, DIG. 17, 30; 366/88, 90; 425/208, 209

[56] References Cited

U.S. PATENT DOCUMENTS

| | | | |
|---|---|---|---|
| 3,294,133 | 12/1966 | Claas | 241/260.1 X |
| 4,165,045 | 8/1979 | Hager et al. | 241/283 X |
| 4,168,805 | 9/1979 | Taylor | 241/260.1 X |
| 4,258,886 | 3/1981 | Lundahl et al. | 241/101.7 |

FOREIGN PATENT DOCUMENTS

| | | | |
|---|---|---|---|
| 1262173 | 3/1978 | Fed. Rep. of Germany | 241/260.1 |

*Primary Examiner*—Mark Rosenbaum

*Attorney, Agent, or Firm*—Vogt and O'Donnell

[57] ABSTRACT

A method and apparatus for disintegrating soft food materials. A disintegrating element having screw threads and cutting edges on the periphery of the threads is rotated about its axis and reciprocated in directions substantially parallel to a surface of a mass of the material to be comminuted. The cutting edges engage and comminute the material at such surface.

6 Claims, 3 Drawing Figures

METHOD OF AND A MACHINE FOR DISINTEGRATING MATERIALS

This invention relates to a method of and a machine for disintegrating materials, more particularly food products. The machine according to the invention is primarily intended for the disintegration of food products in the form of fairly large pieces or blocks, such as sausages and compressed meats, but above all cheese.

There are various known machines for disintegrating food products, such as for example graters, slicing machines, mills, etc. These known machines have satisfied the requirements made of them fairly well where it has been a question of producing relatively large pieces, such as slices, or where the products to be disintegrated have been relatively dry and firm, such as raw vegetables, hard and dry cheeses, etc. It has also been possible not only to disintegrate but also to portion the material.

However, disintegration and portioning have involved problems where the products in question have been fairly soft and sticky, such as various delicatessen and cheeses having a high or moderately high fat content. It has been particularly difficult to disintegrate cheese because, due to the fatty and sticky consistency of cheese, the particles obtained have tended to adhere to the cutting implement or even to one another to form fairly large lumps. Hitherto, there has been no machine capable of simultaneously disintegrating and, if necessary, portioning materials as difficult as these in a variable manner. This has given rise to considerable difficulties in the automatic machinery used for the production of prepared dishes, for example when grated cheese has to be sprinkled over a pizza or when a gratin has to be subsequently frozen and delivered in this state to the consumer for final preparation. If, in this case, the cheese is not uniformly distributed over the dish, it will melt unevenly during the final heating so that the finished dish will have a less appetizing appearance.

The present invention enables the disadvantages referred to above to be obviated and provides for the uniform disintegration of food products which, previously, were difficult to use from this point of view. The method and the machine according to the invention are particularly intended for the disintegration of cheese, although other food products in piece form, such as minced meat and pressed ham, may advantageously be disintegrated in accordance with the invention.

In general, conventional machines for disintegrating various food products in piece form have been completely different models according to the type of food product to be treated. It would be extremely desirable both from the practical and from the economic point of view for different types of food products to be able to be treated essentially in the same apparatus in which only a few elements would need to be replaced for adaptation to the different mechanical and rheological properties of different food products. The present invention enables this object to be achieved and the same apparatus may be used for different food products, such as cheese, meat and delicatessen, for example pressed ham and minced meat, sausage either in the form of fairly large individual sausages or in the form of several small sausages together, and other materials, only the elements used for the actual disintegration process having to be specially adapted to the type of food product to be treated.

The method according to the invention is characterised in that the material to be disintegrated is fed to a driven disintegrating element which makes a reciprocating movement substantially parallel to one surface of the material and, in doing so, comminutes the material on that surface. The material is preferably fed intermittently to the disintegrating element which is preferably in the form of a rotary disintegrating element of which the axis of rotation is parallel to the treated surface.

The invention also relates to a machine for disintegrating materials which comprises a driven disintegrating element designed to receive a reciprocating movement substantially parallel to one surface of the material with simultaneous comminution of material on that surface, and a delivery element for feeding the material to the disintegrating element.

In one preferred embodiment of the invention, the driven disintegrating element is in the form of a rotary screw of which the screwthread is provided with a cutting edge directed frontwards in the axial direction along which the screwthread appears to move during rotation of the screw. In one particularly preferred embodiment, the screw is provided with two oppositely directed screwthreads, the two thread directions each occupying part, preferably half, of the length of the screw.

The invention is shown in more detail in the accompanying drawings, wherein:

FIG. 1 diagrammatically illustrates a machine according to the invention in its entirety.

Figure 1:
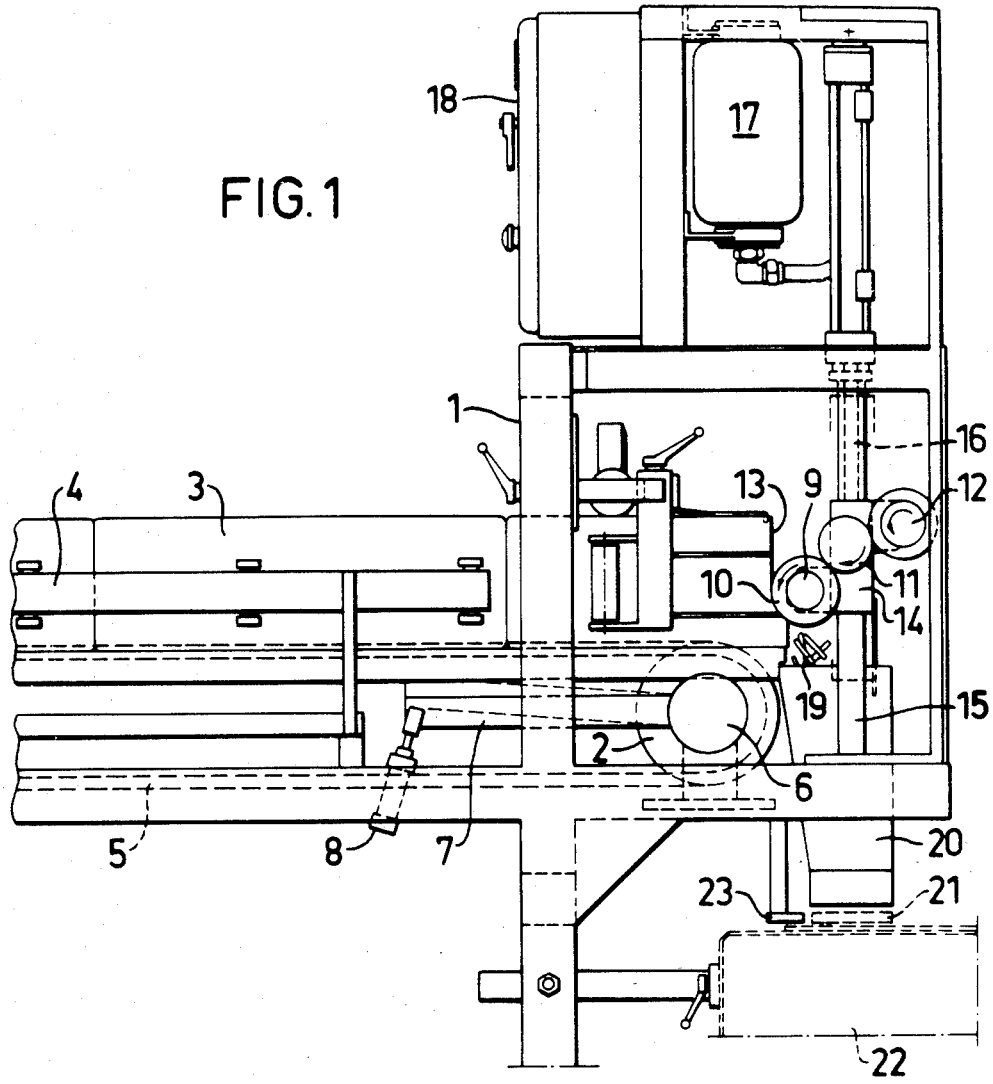

As shown in FIG. 1, the machine consists essentially of a frame 1 supporting a conveyor 2 for a food product 3 in block form, for example a cheese. Guides 4 are also provided to ensure correct feeding. The conveyor is preferably in the form of a chain conveyor with a toothed conveying chain 5 and is driven by a ratchet mechanism 6 of which the control arm 7 is activated by a pneumatic jack 8.

A disintegrating element 9 is driven by a motor 12 through the pinion 10 via the intermediate wheel 11. In the Figure, the disintegrating element is shown as a rotary cutting element and, more particularly, as a rotary screw of the type illustrated in FIG. 2. The cutting element is brought opposite the front surface 13 of the block-form food product and is fixed to a support 14 and the whole assembly may be moved upwards or downwards along guide bars 15 by means of the piston rod 16. The movement is imparted by means of the diagrammatically illustrated apparatus 17 which is controlled by the control unit 18. The axis of disintegrating element 9 extends horizontally, the disintegrating element being depicted in end view in FIG. 2. With the upward and downward motion of support 14, the disintegrating element also moves upwardly and downwardly and hence reciprocates transversely of its axis, the disintegrating element moving in a predetermined plane of reciprocation parallel to guide bars 15 and parallel to the front surface 13 of the food product mass. The particles 19 of the food product which are formed during disintegration fall through the funnel 20 onto a prepared dish 21, for example a pizza, which is delivered by a conveyor, for example a belt conveyor, indicated at 22. A detector 23, which acts on the control unit 18, ensures that no disintegration takes place if there is nothing on the conveyor belt to receive the disintegrated product.

The control unit 18 enables both the advance of the conveyor 2 and the transport and drive of the cutting element 9 to be controlled in such a way that a suitable length of the block-form food product 3 is advanced when the cutting element is in its upper position, respectively in its lowered position, after which the cutting element is lowered, respectively lifted up and driven for disintegration to take place. The ratchet mechanism 6 prevents the block-form food product from rebounding while the cutting element is in operation. It is not always necessary for the cutting element to be driven only when it is in its lowered, respectively in its ascended position, although this does represent a preferred embodiment.

The drive system used for driving the conveyor 2 and the disintegrating element 9 and also for raising and lowering the disintegrating element 9 may be electrical or hydraulic, although it is preferred to use a pneumatic drive system. The reason for this is that any apparatus of the type used for treating food products is often situated in a damp atmosphere and has to be able to be thoroughly cleaned and disinfected, for example by washing under high pressure. In the case of an electrical apparatus, this can give rise to difficulties in the form of short-circuiting and sparking which may also endanger personnel. Control units for controlling pneumatic apparatus in the manner described here are already known to the expert and may be assembled from commercially available components. A hydraulic apparatus may be used on condition that the hydraulic fluid enployed is compatible with food products, for example an edible oil.

Figure 2:
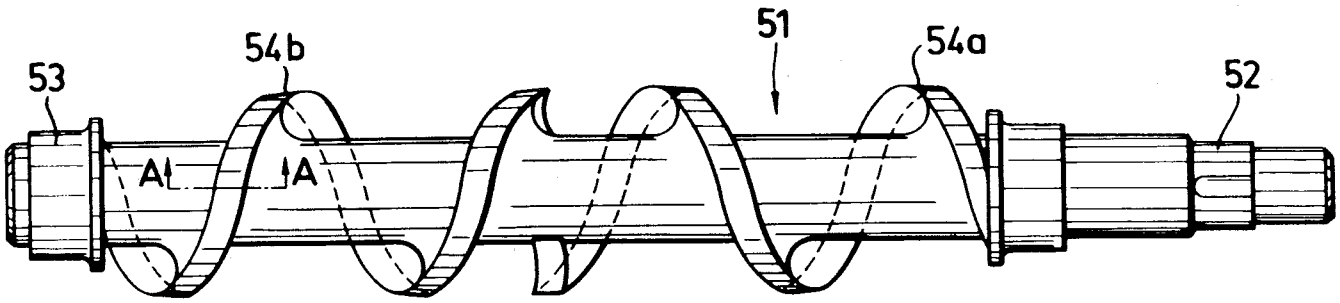
FIG. 2 is a detailed view of a preferred embodiment of the disintegrating element.
Figure 3:
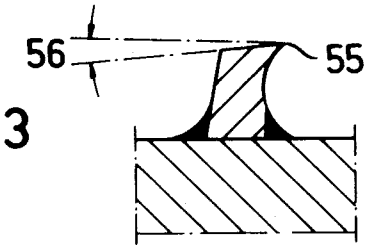
FIG. 3 is a section through part of the disintegrating element illustrated in FIG. 2.

FIGS. 2 and 3 show a particularly preferred embodiment of the disintegrating element according to the invention. In this case, the disintegrating element is in the form of a screw 51 which is driven at one end 52 and mounted in bearings at its other end 53. The screw is provided with a screwthread 54 which, in the particularly preferred embodiment illustrated in the drawing, is divided into a right-hand thread 54*a* and a left-hand thread 54*b*. As shown in FIG. 3, which is a section on the line A—A of FIG. 2, the screwthread has a subtantially trapezoidal cross-section and a cutting edge 55 at one of its upper edges which has a certain taper angle 56 in the axial direction of the screw. It is this cutting edge which comminutes or disintegrates the food product when the screw is rotated by passing over one surface of the material. To be able to effect this comminution, the cutting edge has to be directed frontwards in the direction in which the screwthread appears to move when the screw rotates. Thus, in the embodiment illustrated in the drawing, the screw may be made to rotate anticlockwise, looking from the driving end 52, for comminution to be able to take place.

A certain number of advantages are obtained by virtue of the division of the screwthread into two sections directed towards one another which are therefore homothetic. Thus, the comminuted material will be conveyed towards the centre of the screw to accumulate there before dropping into the funnel so that there is less risk of losses. In addition, the disintegrated material will be remixed and this effect may be used to advantage in that several smaller blocks of different types of material, for example different types of cheese, may be delivered alongside one another and simultaneously disintegrated and remixed. Finally, the oppositely directed threads provide for equalisation of the axial stresses on the bearings of the screw at the two ends thereof.

However, it should be noted that it is not absolutely necessary for the thread of the screw to be divided into two oppositely directed sections and that a unidirectional thread may also be used. In that case, the disintegrated material is delivered in the direction of movement of the thread to one of the sides where it may be suitably collected.

The degree of disintegration of the treated food product is determined by the shape, size and rotational speed of the screw. With a screw according to the invention, food products such as cheese, pressed ham and frozen meat may be disintegrated in the form of more or less fine cuttings or the like. It has been found that a higher rotational speed of the screw and a lower speed of movement of the screw in the vertical direction give thinner cuttings. A rotational speed of from about 3000 to 4000 revolutions per minute and a vertical speed of approximately 5 to 20 cm per second have been found to be suitable. However, values outside these ranges may be used and may be determined by the expert for adaptation to the consistency of the particular material to be treated.

For the screw, a thread diameter of from 2 to 5 cm is suitable, particularly satisfactory results having been obtained with a diameter of approximately 3 cm. The diameter of the screw determines the width of the cuttings formed so that a larger diameter gives wider cuttings. The lead of the screw is also important and, in this connection, a value of approximately 3 to 6 cm per revolution has been found to be suitable. If the lead exceeds about 6 cm, the material leaves the screw unsatisfactorily whereas too small a lead gives very small cuttings. The cutting edge on the screwthread may have a taper angle of from 0° to 5°, a value of approximately 2° having proved to be suitable. The length of the comminuting section is not particularly critical and may be adapted to optionally standardised dimensions of the piece-form food products being treated.

Each of the threads of the screw may also have several inlets so that it is possible to have a plurality of threads oriented in each direction. More intense disintegration may be obtained in this way.

In addition, the delivery rate of the disintegrated material is considered to be important in the sense that a relatively high delivery rate gives relatively wide cuttings. In the preferred embodiment, the material is intermittently delivered when the disintegrating element is in its upper position and a delivery rate of approximately 3 mm per step has given good results under normal conditions.

Finally, it is possible to act on the degree of disintegration in the case of certain materials, for example cheese, by passing the block of material to a cutter which divides it along its longitudinal axis before it reaches the cutting element. In the case of cheese, it may be forced for example beyond one or more cutting wires or grids. In this way, it is possible to obtain shorter cuttings.

Accordingly, it follows that several parameters may be varied for disintegrating the material into particles of the required size and shape. The combination of these parameters which is adopted in each particular case may be selected by the expert in dependence upon the properties of the material to be disintegrated, limitations of the apparatus used, etc.

It is advisable to arrange on each side of the disintegrating element supporting plates, supporting rollers or supporting conveyor belts which are parallel to the surface of the material being treated, the arrangement having to be such that the disintegrating element accommodated in the space between them only projects into what corresponds to the depth of material being treated during each comminution cycle. The piece of material is thus supported and disintegration is facilitated on approaching the end of a block of material.

The direct portioning of material which is obtained with a screw as the cutting element according to the invention enables any other handling of the disintegrating material to be avoided, which saves work and reduces losses of material. Since portioning may be regulated with high precision to the required length, overportioning with its inherent losses is also avoided. The disintegrated material is satisfactorily and uniformly distributed by virtue of the fact that it drops into a funnel and then onto a prepared dish, for example a pizza or a gratin, which passes below the machine on a conveyor. In order to obtain the best results, it is advisable to adapt the size and shape of the funnel to the prepared dish intended to receive the disintegrated material.

In the method according to the invention, a rotary screw as the cutting element has proved to be particularly suitable for the disintegration of cheese and also pressed meats, such as ham or various types of brawn, in the form of blocks of suitable size. The food products may be frozen, refrigerated or kept at ambient temperature and, in some cases, the temperature acts on the treatment properties during disintegration. Thus, in the disintegration of high-fat cheese, it has proved to be advisable to cool the cheese because, in this way, it assumes a less sticky consistency. By contrast, cheese having a fat content of 45% and higher, based on dry matter, may readily be disintegrated at ambient temperature. This is a major advantage of the method and the machine according to the invention over known machines of the greater or similar type where the sticky consistency of cheese gives rise to difficulties.

In one particularly advantageous embodiment of the machine according to the invention, the material to be disintegrated may be continuously delivered. Thus, in the case of cheese for example, the blocks of cheese may be welded together by means of a suitable food-grade binder before delivery to the disintegrator so that there is no interruption in feed. In this case, it is preferred to distribute the constituent material of the binder over several pizzas, which may be obtained for example by arranging the cutting element at an angle of about 10° relative to the front surface of the blocks.

The purely technical design of the machine according to the invention is conventional and may readily be determined by the expert. The helical cutting element is preferably made of stainless steel with a suitable composition for the cutters. The cutting edges of the cutting element do not have to be sharpened particularly often because the majority of food products have a very mild abrasive effect.

It is particularly important for the machine to be able to be readily cleaned in a manner compatible with food products.

We claim:

1. A machine for disintegrating a soft food material comprising:

(a) a disintegrating element having a pair of oppositely directed screw threads disposed about an axis, each of said threads occupying a portion of the length of said disintegrating element;

(b) means for rotating said disintegrating element about said axis in a predetermined direction, each of said threads having at its periphery a substantially continuous cutting edge directed in the axial direction in which such thread appears to move upon rotation in such predetermined direction;

(c) means for reciprocating said disintegrating element transversely of said axis, so that the disintegrating element moves in a predetermined plane of reciprocation; and (d) means for positioning a mass of said soft food material so that a surface of said mass is disposed parallel to said plane of reciprocation and such surface is engaged by said cutting edges.

2. A machine as claimed in claim 1 characterised in that said positioning means includes opposed guide structures, said positioning means being operative to advance the mass between said guide structures.

3. A machine as claimed in claim 1 characterised in that each of said threads has a diameter of approximately 2 to 5 cm.

4. A machine as claimed in claim 3 characterised in that each of said threads has a lead of approximately 3 to 6 cm per revolution.

5. A machine as claimed in claim 3 or claim 1, characterised in that each of said cutting edges has a taper angle towards said axis of from 0° to 5°.

6. A machine as claimed in claim 1, characterised in that said positioning means is operative to advance the mass intermittently, such means including a ratchet mechanism to prevent the mass from rebounding.

* * * * *